US009677458B2

(12) United States Patent
Mushiga

(10) Patent No.: US 9,677,458 B2
(45) Date of Patent: Jun. 13, 2017

(54) TEMPERATURE CONTROL DEVICE FOR INTERNAL COMBUSTION ENGINE

(71) Applicant: TOYOTA JIDOSHA KABUSHIKI KAISHA, Toyota-shi, Aichi-ken (JP)

(72) Inventor: Kentaro Mushiga, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 102 days.

(21) Appl. No.: 14/885,612

(22) Filed: Oct. 16, 2015

(65) Prior Publication Data

US 2016/0258343 A1 Sep. 8, 2016

(30) Foreign Application Priority Data

Mar. 3, 2015 (JP) ..... 2015-041250

(51) Int. Cl.
*F01P 7/16* (2006.01)
*F01P 5/12* (2006.01)
*F01P 11/16* (2006.01)

(52) U.S. Cl.
CPC ..... *F01P 7/164* (2013.01); *F01P 5/12* (2013.01); *F01P 7/162* (2013.01); *F01P 11/16* (2013.01);
(Continued)

(58) Field of Classification Search
CPC .... F01P 7/164; F01P 7/162; F01P 5/12; F01P 11/16; F01P 3/00; F01P 3/02; F01P 3/12;
(Continued)

(56) References Cited

U.S. PATENT DOCUMENTS 7,429,128 B2 * 9/2008 Izumiura ..... F02D 41/222 374/1
7,975,536 B2 * 7/2011 Bommer ..... F02D 41/222 73/114.68

(Continued)

FOREIGN PATENT DOCUMENTS

| | | |
|---|---|---|
| JP | 2012057510 A | 3/2012 |
| JP | 2014148978 A | 8/2014 |
| WO | 2011111174 A1 | 9/2011 |

*Primary Examiner* — Grant Moubry
(74) *Attorney, Agent, or Firm* — Oliff PLC

(57) ABSTRACT

A temperature control device for an internal combustion engine includes a determining drive processor and an abnormality determining processor. The determining drive processor drives an electric pump when the difference between the water temperature and the ambient temperature is greater than or equal to a predetermined value while the electric pump is stopped. The abnormality determining processor determines that at least one of the water temperature sensor and the ambient temperature sensor is abnormal on a condition that the decrease amount of the water temperature. The determining drive processor includes a stopping processor, which stops driving of the electric pump when the cumulative amount of coolant discharged from the electric pump reaches the predetermined cumulative amount with driving of the electric pump. The predetermined cumulative amount is set according to the volume of the engine passage between the inlet of the engine passage and the water temperature sensor.

6 Claims, 3 Drawing Sheets

(52) U.S. Cl.
CPC ..... *F01P 2025/13* (2013.01); *F01P 2025/32* (2013.01); *F01P 2031/20* (2013.01)

(58) Field of Classification Search
CPC ..... F01P 2031/20; F01P 2025/13; F01P 2025/32; F04B 49/00; F04B 49/106; F04B 49/06; G01K 13/02
See application file for complete search history.

(56) References Cited

U.S. PATENT DOCUMENTS

| | | | | |
|---|---|---|---|---|
| 8,140,246 | B1 | 3/2012 | Manchanda | |
| 8,479,569 | B2 * | 7/2013 | Sugimoto | F01P 7/164 73/114.68 |
| 8,573,163 | B2 * | 11/2013 | Kinomura | F01P 7/165 123/41.02 |
| 8,695,552 | B2 * | 4/2014 | Onozawa | H05B 1/0236 123/142.5 E |
| 8,978,598 | B2 * | 3/2015 | Iwai | F01P 11/16 123/41.15 |
| 9,261,012 | B2 * | 2/2016 | Saitoh | F01P 7/165 |
| 9,534,985 | B2 * | 1/2017 | Oda | G01M 15/048 |
| 2012/0055663 | A1 | 3/2012 | Onozawa et al. | |
| 2012/0318214 | A1 | 12/2012 | Iwai | |

* cited by examiner

TEMPERATURE CONTROL DEVICE FOR INTERNAL COMBUSTION ENGINE

BACKGROUND OF THE INVENTION

The present invention relates to a temperature control device for an internal combustion engine. The temperature control device is applied to a system that includes an internal combustion engine, a cooling circuit, an electric pump, a water temperature sensor, and an ambient temperature sensor. The internal combustion engine has an engine passage, which is a passage for coolant. The cooling circuit is arranged outside the internal combustion engine and is coupled to the engine passage. The electric pump circulates the coolant. The water temperature sensor is arranged in the internal combustion engine. The ambient temperature sensor detects the ambient temperature, which is the temperature of gas surrounding the internal combustion engine.

For example, International Publication No. WO2011/111174 discloses a control device that drives an electric water pump (an electric pump) and detects the presence or absence of water temperature decrease when the difference between the detected values of a water temperature and an intake air temperature (an ambient temperature) is greater than or equal to a predetermined value at the start of the internal combustion engine. The device determines that at least one of the water temperature sensor and the intake air sensor (an ambient temperature sensor) is abnormal when the water temperature does not decrease after the electric water pump is driven.

This device utilizes the behavior that the coolant and the ambient air will reach thermal equilibrium when the internal combustion engine is in the stopped state and determines that a sensor is abnormal on the condition that the difference between the detected value of the water temperature sensor and the detected value of the ambient temperature sensor is large at the start. However, the coolant and the ambient air do not reach thermal equilibrium when heating treatment is performed on the coolant of the internal combustion engine by a heater such as a block heater mounted on the internal combustion engine while fuel supply to the internal combustion engine is stopped. Since the block heater is used to heat the coolant held in the internal combustion engine, the coolant temperature outside the internal combustion engine converges to a near value of the ambient temperature. Thus, the water temperature near the water temperature sensor decreases when the electric pump is driven. For this reason, when the water temperature detected by the water temperature sensor decreases with driving of the electric pump, it is determined that the large difference results from heating treatment by a heater such as the block heater. Thus, false abnormality determination can be avoided.

As described above, the point in time at which the water temperature detected by the water temperature sensor drops due to driving of the electric pump is when the coolant that has received little heat from a heater such as the block heater reaches the water temperature sensor. For this reason, when the electric pump is driven for an extended period of time beyond the time point, the electric pump is driven for a longer time than normal time necessary for abnormality determination. This increases time necessary for warm-up completion of the internal combustion engine. However, International Publication No. WO2011/111174 does not describe stopping of the electric pump after driving of the electric pump.

SUMMARY OF THE INVENTION

It is an objective of the present invention to provide a temperature control device for an internal combustion engine that achieves two advantages, which are ensuring the accuracy of abnormality determination and reduction in time necessary for warm-up.

One aspect to achieve the above objective provides a temperature control device for an internal combustion engine. The temperature control device for an internal combustion engine is applied to a system that includes an internal combustion engine, which has therein an engine passage, which is a passage for coolant, a cooling circuit, which is arranged outside the internal combustion engine and is coupled to the engine passage, an electric pump, which is configured to circulate the coolant, a water temperature sensor, which is arranged in the internal combustion engine, and an ambient temperature sensor, which is configured to detect an ambient temperature, which is a temperature of gas surrounding the internal combustion engine. The temperature control device comprises a determining drive processor and an abnormality determining processor. The determining drive processor is configured to drive the electric pump when a difference between a water temperature detected by the water temperature sensor and an ambient temperature detected by the ambient temperature sensor is greater than or equal to a predetermined value while the electric pump is stopped. The abnormality determining processor, which is configured to determine that at least one of the water temperature sensor and the ambient temperature sensor is abnormal on a condition that a decrease amount of a water temperature detected by the water temperature sensor that results from driving the electric pump by the determining drive processor is less than or equal to a predetermined amount. The determining drive processor includes a stopping processor, which stops driving of the electric pump when a cumulative amount of the coolant discharged from the electric pump reaches a predetermined cumulative amount with driving of the electric pump by the determining drive processor. The predetermined cumulative amount is set according to an inside volume of the engine passage between an inlet of the engine passage and the water temperature sensor.

Other aspects and advantages of the discloser will become apparent from the following description, taken in conjunction with the accompanying drawings, illustrating by way of example the principles of the disclosure.

BRIEF DESCRIPTION OF THE DRAWINGS

The features of the present disclosure that are believed to be novel are set forth with particularity in the appended claims. The disclosure, together with objects and advantages thereof, may best be understood by reference to the following description of the presently preferred embodiments together with the accompanying drawings in which:

DETAILED DESCRIPTION OF THE PREFERRED EMBODIMENTS

A temperature control device according to one embodiment of the present invention will now be described with reference to the drawings.

Figure 1:
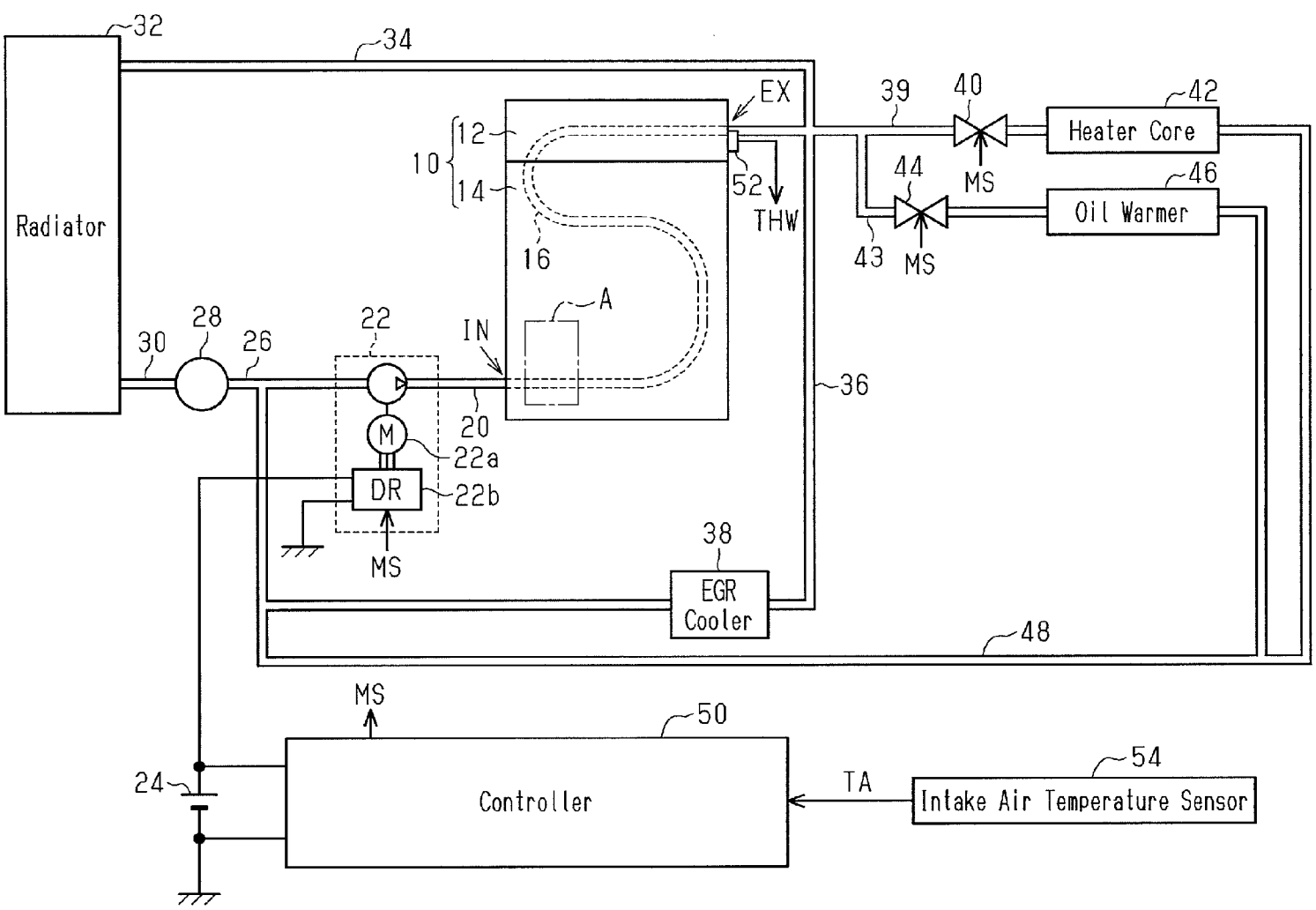
FIG. 1 is a diagram showing a system including a temperature control device according to one embodiment.

FIG. 1 shows an internal combustion engine 10, which includes a metallic cylinder head 12 and a cylinder block 14. The cylinder head 12 and the cylinder block 14 have an engine passage 16, through which coolant for cooling the internal combustion engine 10 circulates. The coolant is not limited to a coolant containing only water molecules. The coolant may be a liquid that contains constituents other than water molecules to have a desired function, e.g., antifreeze having a freezing point lower than that of water. The engine passage 16 is coupled to a cooling circuit, which is located outside the cylinder head 12 and the cylinder block 14.

In particular, an inlet IN for coolant of the engine passage 16 is coupled to an inlet passage 20, which is formed by a rubber hose. The inlet passage 20 is coupled to a discharge port of an electric pump 22. The electric pump 22 is an actuator that gives a flow velocity to coolant to circulate the coolant. The electric pump 22 is provided with a motor 22*a* and a driving circuit 22*b*, which drives the motor 22*a*. The driving circuit 22*b* is coupled to a battery 24. The motor 22*a* is supplied with electric power of the battery 24 via the driving circuit 22*b*. The driving circuit 22*b* is capable of changing the amount of electric power, which is input to the electric pump 22 from the battery 24. In other words, the driving circuit 22*b* is capable of changing the power consumption of the electric pump 22.

An intake port of the electric pump 22 is coupled to radiator downstream passages 26 and 30. A thermostat 28 is arranged between the radiator downstream passages 26 and 30. The radiator downstream passage 30 is coupled to a radiator 32. The radiator 32 is a heat exchanger for cooling coolant and releases heat of the coolant to ambient air.

The radiator 32 is coupled to a radiator upstream passage 34. The radiator upstream passage 34 is coupled to an exit EX of the engine passage 16.

The exit EX is coupled to an exhaust gas recirculation (EGR) cooler passage 36. The EGR cooler passage 36 is coupled to the radiator downstream passage 26. An EGR cooler 38 is arranged in a portion of the EGR cooler passage 36. The EGR cooler 38 is a cooler for cooling EGR gas with coolant. The EGR gas is exhaust gas that is sent back to an intake passage after being discharged from a combustion chamber, i.e., exhaust gas that will be delivered into the combustion chamber through the intake passage.

The exit EX is further coupled to a core upstream passage 39. The core upstream passage 39 is coupled to a heater core 42, which warms air supplied to the passenger compartment with heat of the coolant. The heater core 42 is coupled to a return passage 48. The return passage 48 is coupled to the radiator downstream passage 26. This allows the coolant that has flowed out from the exit EX to flow into the inlet IN through the core upstream passage 39, the heater core 42, and the return passage 48. A core valve 40 is arranged in a portion of the core upstream passage 39 and adjusts the flow passage area of the core upstream passage 39. The closed core valve 40 prevents the core upstream passage 39, the heater core 42, and the return passage 48 from forming a passage for circulating coolant with the engine passage 16.

The exit EX is coupled to a warmer upstream passage 43. The warmer upstream passage 43 is coupled to an oil warmer 46, which warms hydraulic fluid of a transmission with heat of the coolant. The oil warmer 46 is coupled to the return passage 48. This allows the coolant that has flowed out from the exit EX to flow into the inlet IN through the warmer upstream passage 43, the oil warmer 46, and the return passage 48. A warmer valve 44 is arranged in a portion of the warmer upstream passage 43 and adjusts the flow passage area of the warmer upstream passage 43. The closed warmer valve 44 prevents the warmer upstream passage 43, the oil warmer 46, and the return passage 48 from forming a passage for circulating coolant with the engine passage 16.

The above-illustrated cooling circuit includes the inlet passage 20, the electric pump 22, the radiator downstream passage 26, the thermostat 28, the radiator downstream passage 30, the radiator 32, the radiator upstream passage 34, the EGR cooler passage 36, the EGR cooler 38, the core upstream passage 39, the core valve 40, the heater core 42, the warmer upstream passage 43, the warmer valve 44, the oil warmer 46, and the return passage 48.

A controller 50 serves as an electronic control unit that controls the internal combustion engine 10. The controller 50 also serves as a temperature control device that controls the temperature of coolant to control the charging efficiency and the like of the internal combustion engine 10. The controller 50 transmits an operation signal MS to the core valve 40 and the warmer valve 44 to open or close the respective valves 40 and 44.

The controller 50 obtains a water temperature THW that is detected by a water temperature sensor 52 arranged in the internal combustion engine 10 and drives or stops the electric pump 22 according to the water temperature THW. In particular, the controller 50 drives the motor 22*a* via the driving circuit 22*b* by transmitting an operation signal MS to the driving circuit 22*b* and stops the motor 22*a* by stopping transmission of the operation signal MS. The water temperature sensor 52 is immersed in coolant that is present in a portion at the exit EX of the engine passage 16. In the present embodiment, the inlet IN is located in the vertically lowest portion of the engine passage 16. The exit EX is located in the vertically highest portion of the engine passage 16. This setting facilitates the coolant temperature around the exit EX to become the highest of the coolant temperature in the engine passage 16 while the electric pump 22 is stopped. This enables appropriate determination of whether the internal combustion engine 10 needs to be cooled, i.e., whether to drive the electric pump 22, according to the water temperature THW detected by the water temperature sensor 52.

The controller 50 executes a determination process, which determines the presence or absence of abnormality in the water temperature sensor 52. In particular, the controller 50 obtains an ambient temperature TA detected by an intake air temperature sensor 54 for detecting an ambient temperature, which is the temperature of gas surrounding the internal combustion engine 10. The controller 50 determines the presence or absence of abnormality in the water temperature sensor 52 based on comparison between the water temperature THW and the ambient temperature TA. The intake air temperature sensor 54 is a sensor that is exposed to gas in the intake passage of the internal combustion engine 10 to detect the temperature. Since the gas temperature in the intake passage is regarded as the temperature of gas surrounding the internal combustion engine 10, the detected value of the intake air temperature sensor 54 is the ambient temperature TA in the present embodiment.

Figure 2:
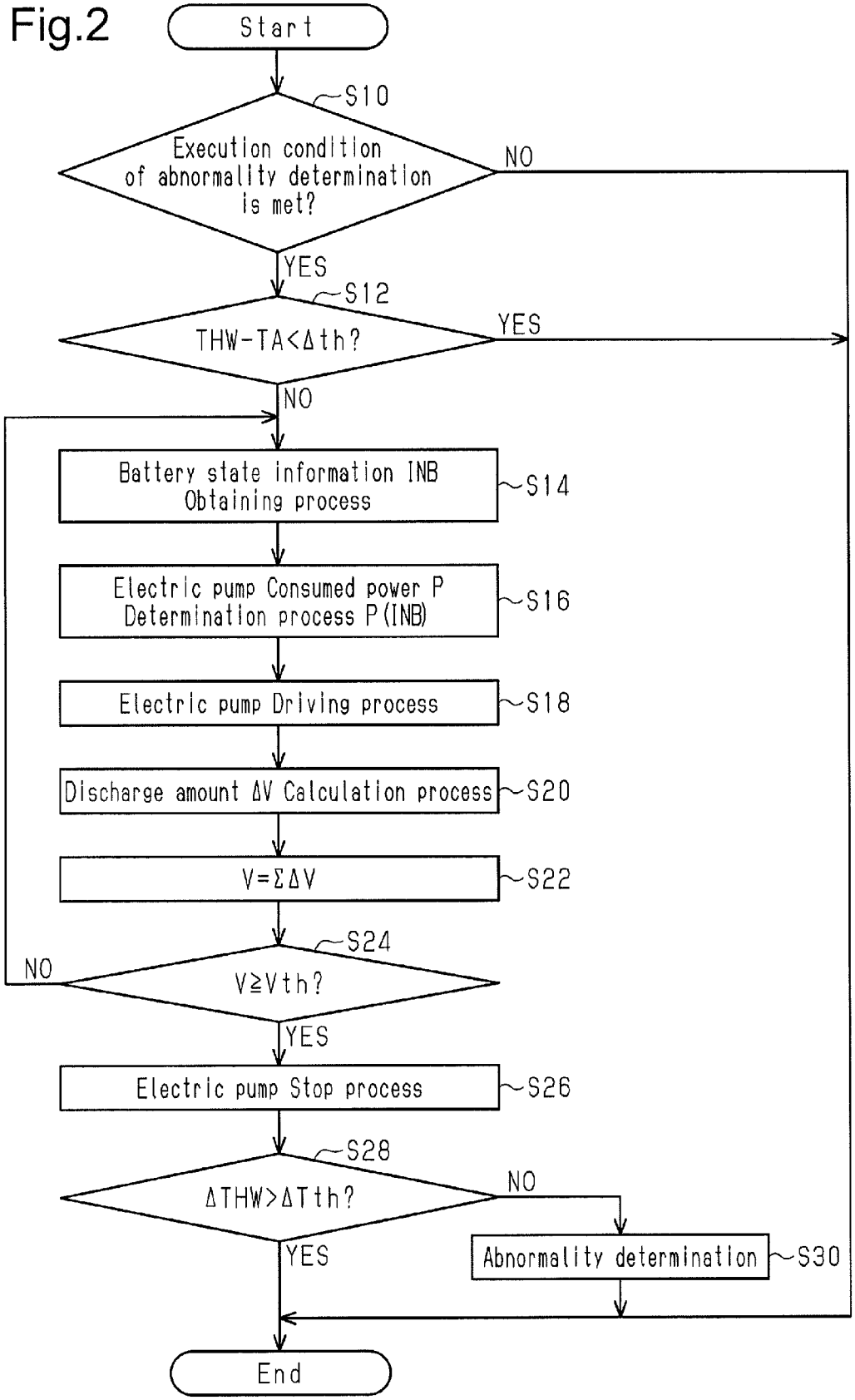
FIG. 2 is a flowchart showing the procedure of abnormality determination processes according to the embodiment.

FIG. 2 shows the procedure of the abnormality determination processes. The processes shown in FIG. 2 are repeatedly executed by the controller 50 at predetermined periods.

In the series of processes, the controller 50 first determines whether an execution condition of abnormality determination is met (S10). For example, a condition (1) is that the internal combustion engine 10 is at the start, and a condition (2) is that at least a predetermined period of time has elapsed from the previous stop to the current start. When the logical conjunction of the conditions (1) and (2) is true, the execution condition is met. Here, the condition (2) is a condition for bringing the coolant and the gas surrounding the internal combustion engine 10 to sufficient thermal equilibrium. The predetermined period of time is set to a time required for bringing the coolant and the gas surrounding the internal combustion engine 10 close to sufficient thermal equilibrium. The condition (1) is a condition for determining the presence or absence of abnormality in the water temperature sensor 52 immediately before the operation of the vehicle and, in addition, for inhibiting the terminal voltage of the battery 24 from decreasing due to the driving process of the electric pump 22, which will be described below. In other words, when the crank shaft of the internal combustion engine 10 rotates, some of the rotational energy of the crank shaft can be converted into electric power by an alternator. Thus, the decrease in the terminal voltage of the battery 24 due to driving of the electric pump 22 can be avoided.

When the execution condition of abnormality determination is met (S10: YES), the controller 50 determines whether the difference between the water temperature THW and the ambient temperature TA is less than a predetermined value Δth (S12). This process is used for determining whether the water temperature sensor 52 is abnormal. In other words, when condition (1) is met, it is assumed that the gas surrounding the internal combustion engine and the coolant are sufficiently close to thermal equilibrium. Thus, it is assumed that the difference between the water temperature THW and the ambient temperature TA is small. Accordingly, when the difference between the water temperature THW and the ambient temperature TA is less than the predetermined value Δth, the controller 50 determines that the water temperature sensor 52 is normal.

When determining that the difference between the water temperature THW and the ambient temperature TA is greater than or equal to the predetermined value Δth (S12: NO), the controller 50 determines that the water temperature sensor 52 may be abnormal and executes a process for determining whether coolant was in a state of being heated before the start of the internal combustion engine 10 after the internal combustion engine 10 was stopped. A situation in which the coolant is heated before the start of the internal combustion engine 10, for example, includes a case in which the coolant is heated by energizing the block heater, which is mounted on the cylinder block. The block heater is mounted on a portion vertically below the internal combustion engine 10 as indicated by an area A shown in FIG. 1. Although the attaching position of the block heater is specified, the controller 50 does not necessarily need to have information of whether the block heater is mounted on the internal combustion engine 10. In the following, it is especially assumed that the controller 50 does not have history information that the block heater has heated the coolant.

The controller 50 obtains battery state information INB to drive the electric pump 22 (S14). In the present embodiment, the terminal voltage of the battery 24 is used as the battery state information INB. The controller 50 then determines the consumed power P of the electric pump 22 based on the battery state information INB (S16). This serves for avoiding a situation in which the voltage of the battery 24 excessively decreases. In particular, this is realized by, for example, decreasing the consumed power P when the terminal voltage of the battery 24 is low in comparison with when the terminal voltage of the battery 24 is high.

The controller 50 drives the electric pump 22 according to the determined consumed power P (S18). Next, the controller 50 calculates the discharge amount ΔV of the electric pump 22 per unit time (S20). In particular, the controller 50 calculates the discharge amount ΔV using map data, which is stored in the controller 50.

Figure 3:
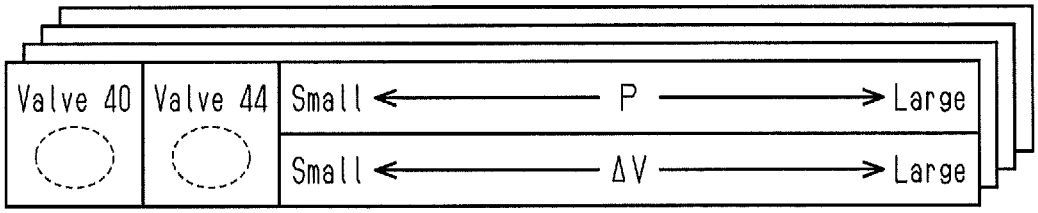
FIG. 3 is a map used in calculation of a discharge amount according to the embodiment.

FIG. 3 shows the map data. As shown in FIG. 3, the map data defines the relationship between the consumed power P and the discharge amount ΔV according to the open/closed state of the core valve 40 and the open/closed state of the warmer valve 44. When the open/closed state of the core valve 40 and the open/closed state of the warmer valve 44 are given, the greater the consumed power P, the greater the value of the discharge amount ΔV is set at. However, the discharge amount ΔV is not uniquely determined according to the consumed power P but depends on the open/closed state of the core valve 40 and the open/closed state of the warmer valve 44.

With reference to FIG. 2, the controller 50 executes a process for calculating a cumulative amount V by integrating the discharge amount ΔV after the start of the process at step S18 (S22). The controller 50 then determines whether the cumulative amount V is greater than or equal to the predetermined cumulative amount Vth (S24). This process is used for determining whether the electric pump 22 should be stopped. The predetermined cumulative amount Vth is set at the volume of the engine passage 16. This is a setting for completely replacing the coolant in the engine passage 16 by the coolant that has been present outside the engine passage 16 before the electric pump 22 is driven.

When determining that the cumulative amount V has not reached the predetermined cumulative amount Vth (S24: NO), the controller 50 returns to the process at step S14. The unit time for defining the discharge amount ΔV may be set at a repeating period when the processes at steps S14 to S24 are repeatedly executed.

When determining that the cumulative amount V is greater than or equal to the predetermined cumulative amount Vth (S24: YES), the controller 50 stops the electric pump 22 (S26). The controller 50 then determines whether the decrease amount ΔTHW between the current water temperature THW and the water temperature THW when the process at step S12 is executed is greater than a predetermined amount ΔTth (S28). This process is used for determining whether the water temperature sensor 52 is abnormal. In other words, when the decrease amount ΔTHW of the water temperature THW is greater than the predetermined amount ΔTth, it is assumed that a factor of negative determination at step S12 is that the coolant and the gas surrounding the internal combustion engine 10 are far from thermal equilibrium. In contrast, when the decrease amount ΔTHW of the water temperature THW is less than or equal to the predetermined amount ΔTth, it is assumed that the negative determination is concluded at step S12 although the coolant and the gas surrounding the internal combustion engine 10 are quite close to thermal equilibrium. Thus, when determining that the decrease amount ΔTHW of the water temperature THW is less than or equal to the predetermined amount ΔTth (S28: NO), the controller 50 determines that the water temperature sensor 52 is abnormal (S30).

The controller 50 stops the current series of processes on positive determination at step S12 or S28 and on negative determination at step S10, and further on completion of the process at step S30.

The operation of the present embodiment will now be described.

The controller 50 drives the electric pump 22 when determining that the difference between the water temperature THW and the ambient temperature TA is greater than or equal to the predetermined value Δth after the execution condition of abnormality determination of the water temperature sensor 52 is met. The electric pump 22 is stopped at a point in time when the coolant in the engine passage 16 is completely replaced by the coolant that has been present outside the engine passage 16 before the electric pump 22 is driven. It is then determined whether the decrease amount ΔTHW of the water temperature THW detected by the water temperature sensor 52 is greater than the predetermined amount ΔTth. When the block heater is mounted on the internal combustion engine 10 and heating treatment is performed by the block heater while the internal combustion engine 10 is stopped, the coolant in the engine passage 16 and the gas surrounding the internal combustion engine 10 do not get close to thermal equilibrium. In particular, on heating by the block heater mounted in the area A of FIG. 1, the heat of the block heater diffuses into the cylinder block 14 and the cylinder head 12 since the cylinder block 14 and the cylinder head 12 have high thermal conductivities. When heat is given to the coolant in a vertically low portion of the engine passage 16, which is located around the block heater, the heat transfers to a vertically high portion of the engine passage 16 by convection of the coolant. Thus, the temperature of the coolant in the engine passage 16 is greatly increased with the heat of the block heater.

In contrast, a portion surrounding the inlet passage 20, which has a lower thermal conductivity than the cylinder block 14 and the cylinder head 12, does not easily receive heat from the block heater. Furthermore, transfer of heat by convection of the coolant does not easily occur in the inlet passage 20, which is located vertically lower than around the exit EX.

For this reason, in a case in which the internal combustion engine 10 is heated by the block heater while the internal combustion engine 10 is in a stopped state, the water temperature THW detected by the water temperature sensor 52 is expected to decrease if the coolant in the engine passage 16 is replaced by the coolant that has been present outside the engine passage 16 before the electric pump 22 is driven. When the water temperature THW does not decrease, it is assumed that either the coolant has not been heated by block heater or the water temperature sensor 52 is abnormal. When the coolant has not been heated, taking into consideration the fact that the difference between the water temperature THW and the ambient temperature TA is greater than or equal to the predetermined value Δth before the electric pump 22 starts being driven, it is assumed that the water temperature sensor 52 is abnormal. However, when the water temperature sensor 52 is abnormal although the coolant is heated, the water temperature THW may possibly not be decreased by driving the electric pump 22. In either case, it is determinable that the water temperature sensor 52 is abnormal when the decrease amount ΔTHW of the water temperature THW is less than or equal to the predetermined amount ΔTth.

Moreover, the electric pump 22 is stopped when the cumulative amount V of the discharge amount ΔV becomes the predetermined cumulative amount Vth. When the internal combustion engine 10 is heated by the block heater while the internal combustion engine 10 is in a stopped state, the water temperature THW detected by the water temperature sensor 52 is expected to decrease at a point in time when the cumulative amount V of the discharge amount ΔV reaches the predetermined cumulative amount Vth. Thus, driving of the electric pump 22 more than necessary can be avoided.

According to the above illustrated embodiment, the following advantages are achieved.

(1) When the cumulative amount V of the discharge amount ΔV reaches the predetermined cumulative amount Vth, the controller 50 stops driving the electric pump 22. This achieves two advantages, which are ensuring the accuracy of abnormality determination and reduction in time necessary for warm-up.

(2) The controller 50 calculates the discharge amount ΔV of the electric pump 22 per unit time based on the consumed power P and determines whether the cumulative amount V of the discharge amount ΔV will become the predetermined cumulative amount Vth. The discharge amount ΔV is larger when the consumed power P is large than when the consumed power P is small. Thus, the time required for the total discharge amount of the electric pump 22 to reach the predetermined cumulative amount Vth is shorter when the consumed power P is large than when the consumed power P is small. When the discharge amount ΔV is calculated as above based on the consumed power P, the time required for the cumulative amount V of the discharge amount ΔV to reach the predetermined cumulative amount Vth is shorter when the consumed power P is large than when the consumed power P is small. Thus, driving of the electric pump 22 for a longer time than necessary can be avoided in an appropriate manner.

(3) The controller 50 calculates the discharge amount ΔV according to the open/closed states of the core valve 40 and the warmer valve 44. Thus, even when the consumed power P is constant, the discharge amount ΔV of the electric pump 22 varies according to the circulation path of the coolant. Consideration of this allows calculation of the discharge amount ΔV of the electric pump 22 to be highly accurate. In other words, the time required for the cumulative amount V of the discharge amount ΔV to reach the predetermined cumulative amount Vth is shorter when the open/closed states of the valves 40 and 44 are states to increase the discharge amount ΔV than when the open/closed states of the valves 40 and 44 are states to decrease the discharge amount ΔV. Thus, driving of the electric pump 22 for a longer time than necessary can be avoided in an appropriate manner.

(4) The predetermined cumulative amount Vth is the inside volume of the engine passage 16. Thus, when the internal combustion engine 10 is heated by the block heater, driving of the electric pump 22 for a longer time than necessary can be avoided in an appropriate manner, while the temperature of the coolant near the water temperature sensor 52 is stably decreased.

<Other Embodiments>

The above-illustrated embodiment may be modified in the following forms. In the following, the correlation between matters described in the "summary of the invention" section and the above embodiment is illustrated by an example using reference numerals and the like. However, the above matters are not limited to the illustrated correlation.

As to the predetermined cumulative amount (Vth):

The predetermined cumulative amount Vth is not limited to the inside volume of the engine passage 16 of the internal combustion engine 10. For example, the predetermined cumulative amount Vth may be slightly greater than the inside volume of the engine passage 16 of the internal combustion engine 10. For example, when the water temperature sensor 52 is arranged near the inlet IN in the engine passage 16, the predetermined cumulative amount Vth may be less than the volume of the engine passage 16. In this case, the predetermined cumulative amount Vth is preferably in the order of the volume of the engine passage 16 between the inlet IN and the water temperature sensor 52.

The condition that the predetermined cumulative amount Vth is set according to the inside volume of the engine passage 16 between the inlet of the engine passage 16 and the water temperature sensor 52 does not mean that the predetermined cumulative amount Vth is set only according to the volume. In particular, for example, the condition that the predetermined cumulative amount Vth is set according to the volume of the engine passage 16 does not mean that the predetermined cumulative amount Vth is set based only on the inside volume of the engine passage 16. It is assumed that the engine passage 16 has another exit in the cylinder block 14 shown in FIG. 1. For example, when second and third exits are provided, the cumulative amount of the coolant discharged from the electric pump 22 until the coolant that has been present outside the engine passage 16 before the electric pump 22 is driven reaches the water temperature sensor 52 cannot possibly be determined based only on the inside volume of the engine passage 16. In this case, the predetermined cumulative amount Vth is preferably set in consideration of the coolant flowing out from the second exit and the like.

As to the discharge amount calculation processor (S20):

The map that defines the relationship between the consumed power P and the discharge amount ΔV is not limited to a map that defines the relationship between the consumed power P and the discharge amount ΔV for each of the open/closed states of the core valve 40 and the warmer valve 44. For example, the map may define the relationship between the ambient temperature TA and the discharge amount ΔV and the relationship between the consumed power P and the discharge amount ΔV for each of the open/closed states of the core valve 40 and the warmer valve 44. In this case, the map may be modified as long as the lower the ambient temperature TA is, the smaller the discharge amount ΔV is set for the same consumed power P. Since the lower the water temperature is, the higher the viscosity of the coolant becomes, it is possible to take into account the fact that the discharge amount ΔV decreases when the viscosity is high in comparison with when the viscosity is low.

In the process at step S18, the condition that the map varies for each of the open/closed states of the core valve 40 and the warmer valve 44 is not required if the open/closed states of the core valve 40 and the warmer valve 44 are set to particular states for the process at the step S18. Even if the open/closed states of the core valve 40 and the warmer valve 44 are not preset to the particular states for the process at step S18, the condition that the map varies for each of the open/closed states of the core valve 40 and the warmer valve 44 is not required. In this case, the above map when the open/closed states of the core valve 40 and the warmer valve 44 are set to minimize the discharge amount is employed.

In the above-illustrated embodiment, when the discharge amount ΔV of the electric pump 22 is calculated, the open/closed state of the thermostat 28 is not taken into account in particular. In a circumstance in which the block heater is used, the thermostat 28 is assumed to be closed, and the open/closed state of the thermostat 28 does not need to be taken into consideration. However, for example, if the thermostat 28 is an electronically-controlled type and may be intentionally opened, it is preferable to calculate the discharge amount ΔV according to the open/closed state of the thermostat 28 to improve calculation accuracy of the discharge amount ΔV.

Calculation of the discharge amount ΔV according to the open/closed state of a valve is not limited to calculation in which the discharge amount ΔV varies between the open state and the closed state. For example, the calculation may be performed such that the discharge amount ΔV has three or more different values per opening degree of the valve.

A parameter for calculating the discharge amount ΔV is not limited to the consumed power P. For example, the rotational speed of the motor 22*a* may be used as a parameter for calculating the discharge amount ΔV. The greater the rotational speed, the larger the discharge amount ΔV becomes.

As to the cumulative amount determining processor (S24):

The process for determining whether the cumulative amount of discharged coolant has reached the predetermined cumulative amount Vth is not limited to a process for determining whether the calculated cumulative amount V of the discharge amount ΔV has reached the predetermined cumulative amount Vth. For example, a process for determining whether the time that has elapsed from the start of the driving process of the electric pump 22 at step S18 is greater than or equal to a threshold time may be employed as the cumulative amount determination process. In this case, the threshold time may be set variably according to the consumed power P and the open/closed states of the core valve 40 and the warmer valve 44. This can be realized in the following manner, for example. First, when the consumed power P is the greatest and the open/closed states of the core valve 40 and the warmer valve 44 are set to maximize the discharge amount ΔV for the same consumed power P, time when the cumulative amount of the discharge amount ΔV reaches the predetermined cumulative amount Vth is defined as a reference time. Second, the reference time is set as an initial value of the threshold time, and the threshold time is corrected to extend as necessary according to the actual consumed power P and the actual open/closed states.

Further, for example, as described below, if a determining drive processor drives the electric pump 22 at constant consumed power P, determination of whether the time that has elapsed from the start of driving process of the electric pump 22 at step S18 is greater than or equal to the threshold time may be employed as a cumulative amount determination process. In this case, the threshold time may be fixed.

As to the determining drive processor (S18):

The battery state information INB, which is used for determining the consumed power P of the electric pump 22, is not limited to voltage information of the battery 24. For example, the battery state information INB may be the state of charge (SOC) of the battery 24. Further, not only the battery state information INB but also, for example, the output power of an alternator, which converts the rotational energy of the crankshaft of the internal combustion engine 10 into electric energy, may be taken into account. Without using the battery state information INB, the consumed power P of the electric pump 22 may be set variably based on the output power of the alternator.

However, the consumed power P of the electric pump 22 does not necessarily need to be set variably according to battery information such as the battery state information INB. For example, regardless of the state of the battery 24, the electric power that the battery 24 can supply in a normal state may be set to the consumed power P of the electric pump 22.

As to the abnormality determining processor (S30):

In the above illustrated embodiment, when the decrease amount ΔTHW of the water temperature THW is less than or equal to the predetermined amount ΔTth after the electric pump 22 is driven, it is determined that the water temperature sensor 52 is abnormal. The determination is not limited to this. For example, it may be determined that at least one of the water temperature sensor 52 and the intake air temperature sensor 54 is abnormal. After the determination, the water temperature sensor 52 can be determined to be abnormal if it is determined that the intake air temperature sensor 54 is normal in another process. When the intake air temperature sensor 54 is abnormal, the determination that at least one of the water temperature sensor 52 and the intake air temperature sensor 54 is abnormal holds.

As to the water temperature sensor:

The water temperature sensor does not necessarily need to be arranged at the exit EX. For example, the water temperature sensor may be arranged in the engine passage 16 in the cylinder head 12.

As to the ambient temperature sensor:

The ambient temperature sensor is not limited to the intake air temperature sensor 54. For example, in addition to the intake air temperature sensor 54, a dedicated sensor for abnormality determination, such as the water temperature sensor 52, may be employed as an ambient temperature sensor. The sensor detects the temperature of the gas surrounding the internal combustion engine 10, which gas is expected to realize a thermal equilibrium state with the coolant after the internal combustion engine 10 is stopped.

As to the cooling circuits (20 and 26-48):

The cooling circuit is not limited to the example shown in FIG. 1. For example, when the thermostat 28 is closed, at least one of the heater core 42, the oil warmer 46, and the EGR cooler 38 may be omitted from bypass passages that bypass the radiator 32. The core valve 40 or the warmer valve 44 may be omitted.

A valve for adjusting the flow passage area of a passage through which coolant passes is not limited to the core valve 40 and the warmer valve 44. The cooling circuit may include a plurality of passages for coolant that circulates by driving of the electric pump 22. A valve that excludes some of those passages from circulation paths of the coolant or a valve that changes the flow passage areas of some passages at three or more values may be employed. Even in such a configuration, it is effective to detect the discharge amount of the electric pump 22 according to the open/closed state or the opening degree of a valve.

Therefore, the present examples and embodiments are to be considered as illustrative and not restrictive and the invention is not to be limited to the details given herein, but may be modified within the scope and equivalence of the appended claims.

The invention claimed is:

1. A temperature control device for an internal combustion engine, wherein the device is applied to a system that includes:

the internal combustion engine, which has therein an engine passage, which is a passage for coolant;

a cooling circuit, which is arranged outside the internal combustion engine and is coupled to the engine passage;

an electric pump, which is configured to circulate the coolant;

a water temperature sensor, which is arranged in the internal combustion engine; and an ambient temperature sensor, which is configured to detect an ambient temperature, which is a temperature of gas surrounding the internal combustion engine, the temperature control device comprising:

a determining drive processor, which is configured to drive the electric pump when a difference between a water temperature detected by the water temperature sensor and an ambient temperature detected by the ambient temperature sensor is greater than or equal to a predetermined value while the electric pump is stopped; and an abnormality determining processor, which is configured to determine that at least one of the water temperature sensor and the ambient temperature sensor is abnormal on a condition that a decrease amount of a water temperature detected by the water temperature sensor that results from driving the electric pump by the determining drive processor is less than or equal to a predetermined amount, wherein the determining drive processor includes a stopping processor, which stops driving of the electric pump when a cumulative amount of the coolant discharged from the electric pump reaches a predetermined cumulative amount with driving of the electric pump by the determining drive processor, and the predetermined cumulative amount is set according to an inside volume of the engine passage between an inlet of the engine passage and the water temperature sensor.

2. The temperature control device for an internal combustion engine according claim 1, wherein, when power consumption of the electric pump is large, the stopping processor assumes that the cumulative amount of discharged coolant has reached the predetermined cumulative amount when a shorter period of time has elapsed from when the determining drive processor started driving the electric pump than when the power consumption of the electric pump is small, and the stopping processor stops driving the electric pump based on that assumption.

3. The temperature control device for an internal combustion engine according claim 1, wherein the determining drive processor is designed to vary power consumption of the electric pump, and the stopping processor includes a cumulative amount determining processor, which determines whether the cumulative amount of discharged coolant has reached the predetermined cumulative amount based on one of power consumption of the electric pump and a rotational speed of a motor incorporated in the electric pump.

4. The temperature control device for an internal combustion engine according claim 3, wherein the cumulative amount determining processor includes a discharge amount calculation processor that calculates a discharge amount of the electric pump per unit time based on one of the power consumption of the electric pump and the rotational speed of a motor incorporated in the electric pump, and the cumulative amount determining processor determines whether a cumulative amount of the discharge amount calculated by the discharge amount calculation processor will reach the predetermined cumulative amount.

5. The temperature control device for an internal combustion engine according to claim 1, wherein the predetermined cumulative amount is an amount of coolant that is greater than or equal to an amount of coolant inside the engine passage.

6. The temperature control device for an internal combustion engine according to claim 5, wherein the water temperature sensor is arranged in an exit portion of the engine passage of the internal combustion engine.

* * * * *